US006332493B1

(12) United States Patent
Hallefält et al.

(10) Patent No.: US 6,332,493 B1
(45) Date of Patent: Dec. 25, 2001

(54) DEVICE FOR CONTINUOUS CASTING OF TWO STRANDS IN PARALLEL

(75) Inventors: Magnus Hallefält; Conny Svahn; Erik Svensson, all of Västerås (SE)

(73) Assignee: ABB AB, Västerås (SE)

( * ) Notice: Subject to any disclaimer, the term of this patent is extended or adjusted under 35 U.S.C. 154(b) by 0 days.

(21) Appl. No.: 09/403,274

(22) PCT Filed: Mar. 6, 1998

(86) PCT No.: PCT/SE98/00404

§ 371 Date: Oct. 18, 1999

§ 102(e) Date: Oct. 18, 1999

(87) PCT Pub. No.: WO98/47647

PCT Pub. Date: Oct. 29, 1998

(30) Foreign Application Priority Data

Apr. 18, 1997 (SE) ..... 9701457

(51) Int. Cl.[7] ..... B22D 27/02; B22D 11/10

(52) U.S. Cl. ..... 164/502; 164/466

(58) Field of Search ..... 164/502, 503, 164/504, 466, 468, 133, 147.1

(56) References Cited

U.S. PATENT DOCUMENTS

| | | | | |
|---|---|---|---|---|
| 4,450,890 | * | 5/1984 | Yarwood et al. | 164/452 |
| 4,495,984 | | 1/1985 | Kolberg | 164/468 |
| 4,858,675 | * | 8/1989 | Senillou et al. | 164/503 |
| 4,986,340 | * | 1/1991 | Eriksson et al. | 164/468 |
| 5,033,534 | * | 7/1991 | Suzuki et al. | 164/468 |
| 5,333,672 | * | 8/1994 | Gelfgat et al. | 164/468 |
| 5,381,857 | * | 1/1995 | Tozawa et al. | 164/466 |
| 5,404,933 | * | 4/1995 | Andersson et al. | 164/466 |
| 5,664,619 | * | 9/1997 | Andersson et al. | 164/502 |
| 5,740,855 | * | 4/1998 | Eriksson et al. | 164/502 |
| 5,934,358 | * | 8/1999 | Ellis et al. | 164/466 |
| 6,253,832 | * | 7/2001 | Hallefalt | 164/502 |

FOREIGN PATENT DOCUMENTS

| | | | | |
|---|---|---|---|---|
| 0 040 383 | | 10/1983 | (EP) . | |
| 0 265 796 | | 5/1988 | (EP) . | |
| 0 401 504 | * | 12/1990 | (EP) | B22D/11/10 |
| 0 577 831 A1 | | 1/1994 | (EP) . | |
| 2-75455 | * | 3/1990 | (JP) | B22D/11/10 |
| 3-118949 | * | 5/1991 | (JP) | B22D/11/10 |
| 4-319051 | * | 11/1992 | (JP) | B22D/11/10 |

* cited by examiner

*Primary Examiner*—M. Alexandra Elve
*Assistant Examiner*—Kevin P. Kerns
(74) *Attorney, Agent, or Firm*—Dykema Gossett PLLC

(57) ABSTRACT

A chill mold for the simultaneous casting of two parallel strands and a magnetic brake which generates at least one static or periodic low frequency magnetic field. The chill mold includes a rectangular casting mold and an inner partition which subdivides the rectangular casting mold into two sub-molds, and the magnetic field acts with essentially the same magnetic field direction across the entire width of the rectangular casting mold and has an essentially symmetrical distribution in both sub-molds. The brake includes a first magnet at a first long side of the rectangular casting mold and a second magnet of opposite polarity at the opposite second long side of the rectangular casting mold. The magnetic material in the first and second magnets is distributed such that both magnets have two magnetic sub-poles of the same polarity arranged adjacent to each other along each of the two long-sides of the rectangular casting mold. Each sub-pole is symmetrically arranged along the long-side of the respective sub-mold.

9 Claims, 3 Drawing Sheets

DEVICE FOR CONTINUOUS CASTING OF TWO STRANDS IN PARALLEL

FIELD OF THE INVENTION

The invention relates to a device with magnetic means, a magnetic brake which, in simultaneous casting of two strands by means of a continuous or semi-continuous casting process, is arranged for on the one hand braking a primary flow of hot melt which is introduced into a casting mold, made up of two sub-molds, and on the other hand controlling the secondary flow of melt which then arises in the non solidified parts of the strands in the sub-molds during the forming of the melt to strands.

The invention also relates to a device for simultaneous continuous or semi-continuous casting of two strands, comprising;

a chill mold, including a casting mold divided into two sub-molds, support beams arranged surrounding the casting mold, and chilling means for chilling the chill mold and the support beams, and to provide chilling agent to chill the melt during the casting, and a magnetic brake for applying to the molten metal present in the chill mold at least one static or periodic low frequency magnetic field.

PRIOR ART in continuous and semi-continuous casting processes for forming elongate castings, for continuously cast steel called strands, chill molds are used which are open at the both ends in the casting direction. The chill mold in the present application is understood to have both the casting mold in which the strand is formed, and support beams arranged around the mold, together with the chilling means which are provided for chilling the mold and the support beams, and to provide chilling agent for chilling the melt during the casting. The casting mold may consist of one or more parts, but is normally comprised of four chilled copper plates. The support beams comprise conduits in which chilling agent, preferably water, flows during the casting, and are normally referred to as water beams. The water beams are arranged surrounding the casting mold in good thermal contact with the mold in order to perform its double function of supporting and chilling the casting mold. The casting mold is fed with hot melt through a casting pipe which is submerged in the melt present in the casting mold—closed casting—or through a free tapping jet—open casting. In the casting mold, the hot melt is chilled and formed into a strand. The strand leaves the casting mold continuously and when leaving, it has a solidified skin which from a mechanical point of view is self-supporting, and a center of non-solidified melt. If the hot melt is allowed to flow into the casting mold in an uncontrolled manner, it will, due to its mechanical momentum, penetrate deep into the non solidified parts of the strand, which has a number of negative effects; undesired non-metallic particles present in the melt will penetrate deep into the melt and be trapped there, and furthermore the control of the temperature in the solidification front is rendered more difficult, and thus the control of the casting structure. From EP- 0 040 383, it is known to arrange means for generating a magnetic field adjacent to the casting mold for applying to the melt in the casting mold at least one static or periodic low frequency magnetic field. The magnetic field is applied to act over the melt in order to brake and split an incoming flow of hot melt, and to control the flow of melt in the non solidified parts of a strand which is being formed in the casting mold. Means for generating a magnetic field for the above purpose is at present referred to as a magnetic brake, or, when the magnets are electromagnets, an electromagnetic brake, EMBR. A magnetic brake is comprised of magnets and a magnetic feedback device, i.e. a yoke, which closes the magnetic circuit. Since the magnetic circuit is closed by means of said magnetic feedback device, the magnetic losses in the brake are reduced. The word magnet is, preferably, to be understood as an electromagnet, i.e. a coil which is fed with an electric current with a core of an electric conductor, but in some circumstances, permanent magnets may also be suitable. A brake comprising electromagnets is in the following referred to as an electromagnetic brake. In addition to the previously described qualitative improvements which are obtained when a static or periodic low frequency magnetic field, in the following referred to as a magnetic brake field, is applied to the melt by means of a brake, a number of manufacturing related advantages are achieved. The risk of melt re-melting and penetrating the solidified skin, with resulting long periods of down time in the manufacturing process is reduced, and it has in many cases shown to be possible to obtain an increase in the casting speed.

The chill mold is mounted and suspended in a framework. A vibrating table is arranged to vibrate the framework during casting in order to provide to the chill mold an oscillating motion, said oscillation preferably being in the casting direction. It is common for the electromagnetic brake to be mounted with the chill mold in the same framework, but the chill mold and the brake may be mounted in different frameworks, the latter being preferable when it is desirable to reduce the oscillating mass.

In order to increase production, in some casting plants a plurality of casting strands are formed in parallel. In parallel casting of large dimension strands, notably the casting of plate castings, commonly known as slabs, a rectangular casting mold is used, in which a partition is arranged to divide the casting mold into two sub-molds. Preferably the casting mold has the four conventional wall plates, arranged to constitute the long and short-sides of the casting mold, and at least one additional wall which is arranged as a partition in the casting mold between the sub-molds. In this way a plurality, preferably two slabs may be cast simultaneously in parallel in the same chill mold. This type of casting is commonly known as twin-casting. The partition is called T-wall, twin-wall, and each sub-mold is called T-mold. Each T-mold is provided with at least one hot flow of molten material, from which a casting strand is formed in the above described manner. When an electromagnetic brake, comprising a magnetic core with a width which essentially corresponds to the width of the long side of the original casting mold, is used to brake and subdivide these incoming flows, the magnetic fields which act in the respective sub-mold will be asymmetrical in relation to the incoming melt flow, as shown in FIG. 1. Said asymmetry may under certain circumstances be unfavorable from a metallurgical point of view.

In order to avoid asymmetrical brake fields, it is known, for example, from the European patent EP 0 265 796, known to arrange a brake with a pole pair at each T-mold. The brake described in EP 0 265 796 generates a brake field in accordance with FIG. 1*b*, which shifts polarity between the pole pairs. In order for this brake to generate a brake field which is symmetrical in both molds, the T-wall must be placed symmetrically between said pole pairs, and preferably in the center of the rectangular casting mold. In twin-casting, however, it is common to arrange the T-wall displaceably in relation to the center of the casting mold, to allow casting of strands of different sizes in the two T-molds. A brake according to FIG. 1*a* or 3*a* is therefore unable to generate magnetic fields which are capable of acting symmetrically for different positions of the T-wall without providing the magnets with means for displacing the magnet poles sideways.

Preferably, each pole pair should be displaceable independent of the other pole pair. This requires a lot of space, which is normally not available adjacent to the chill mold. Further, magnetic leak flows between adjacent poles on the same side of the casting mold arise when trying to apply magnetic fields acting on a substantial portion of the width in the both submolds, due to their different polarity. Said leak flows may under certain circumstances disturb the flow in the sub-molds.

As an alternative, a brake is used with a pole width which is larger than the total width of the rectangular casting mold in order to apply a unidirectional magnetic field which acts with essentially the same magnetic field strength across the strands formed in the sub-molds. This arrangement also requires a lot of space, and is therefore difficult to realize at most continuous casters. Further, it is not possible, with a brake with these type of poles, to apply a magnetic field to act symmetrically across the width of the sub-molds in order to optimize braking and secondary flow.

It is an aim of the present invention to provide a device in the form of a magnetic brake for use with continuous or semi-continuous casting of a plurality of strands in parallel in a chill mold.

The chill mold has:

a casting mold which is subdivided into a plurality of sub-molds, and has a rectangular casting mold and at least one partition, support beams provided around the casting mold, and chilling means for chilling the casting mold and the support beams, and the brake is arranged with magnetic means to generate a magnetic field which acts in an essentially uniform way in the sub-molds to brake the primary flows of hot melt entering the sub-molds, and to control the secondary flow in the strands formed in the sub-molds.

Another aim of the present invention is to provide a casting device for simultaneous casting of a plurality of strands in parallel comprising a magnetic brake according to the invention, and a chill mold which has:

a casting mold which is subdivided into a plurality of sub-molds, support beams provided around the casting mold, and chilling means for chilling the casting mold and the support beams.

THE INVENTION

For simultaneous continuous or semi-continuous casting of two strands in parallel in accordance with the invention a chill mold is used, which has a rectangular casting mold with an inner partition subdividing the rectangular casting mold into two sub-molds. In relation hereto, a magnetic brake is used which has a first magnet arranged at a first long-side of the rectangular casting mold, and a second magnet with a polarity which is opposite to the polarity of the first magnet and arranged at the opposing long-side of the rectangular casting mold, for generating at least one static or periodic low frequency magnetic field to act on a primary flow of hot melt entering each of the sub-molds in order to brake and split the primary flow, and to control the secondary flow which in relation thereto arises in the strand. According to the invention, the magnetic material in the magnets is distributed so that said first and second magnets present two magnetic sub-poles with the same polarity. The sub-poles forming part of the same magnet are arranged adjacent to each other along a respective of the two opposing long-sides of the rectangular casting mold in such a way that each sub-pole is symmetrically arranged along the long-side of a respective sub-mold, to generate and apply at least one static or periodic low frequency magnetic field, to act with essentially the same field direction across the entire width of the rectangular casting mold, and with a substantially symmetrical distribution in the respective sub-mold.

In order to reach the above stated aims, the magnetic material at the end of the respective magnet which is directed towards the casting mold is preferably distributed so that said first and second magnet each presents two magnetic sub-poles with the same polarity arranged adjacent to each other along both long-sides of the rectangular casting mold in such a way that the sub-poles are placed symmetrically along the long-side of the respective sub-mold.

According to one embodiment of the invention the magnetic brake has permanent magnets with a width such that they essentially cover the width of the rectangular casting mold. According to the invention, the magnetic material in the permanent magnets is, at least at that end of the permanent magnets which is directed towards the casting mold, distributed in such a way that two magnetic sub-poles are formed along both long-sides of the rectangular casting mold. These magnetic sub-poles are placed symmetrically along the long-side of the respective sub-mold. As a result, the permanent magnets in this magnetic brake will generate a magnetic field and apply to the melt which enters, and is present, in the sub-molds, a magnetic field which essentially has the same magnetic field direction across the entire of the width of the rectangular casting mold, and an essentially symmetrical distribution in both of the sub-molds.

According to a preferred embodiment the magnetic brake has first and a second electromagnets arranged adjacent to the opposing long-sides of the rectangular casting mold. Such an electromagnet comprises a core and a coil provided around said core. According to the invention such a core has a width which essentially covers the width of the rectangular casting mold. Further, the magnetic material in such a core is, at least at the end of the core which is directed towards the casting mold, distributed in such a way that the core will form two magnetic poles placed adjacent to each other along the long-side of the rectangular casting mold with the same polarity. These poles or sub-cores are, according to the invention, placed symmetrically along the long-side of the respective sub-mold. As a result, the magnetic field generated and applied to the melt will present essentially the same magnetic field direction across the entire width of the rectangular casting mold, in combination with an essentially symmetrical distribution in both sub-molds. This distribution of the magnetic material is according to a preferred embodiment of the invention obtained by the core presenting a recess in the magnetic material adjacent to the partition at that end of the core which is directed towards the casting mold. As an alternative, such a core presents an insert of a non-magnetic material adjacent to the partition in that end of the core which is directed towards the casting mold.

According to an alternative embodiment, which is particularly suited for cases where it is not possible to provide wide permanent magnets or electromagnets with wide cores, the magnetic brake has a plurality of magnets along each long-side, and a pole plate arranged between the magnets and the casting mold along the respective long-side. Said pole plates present a width such that they essentially cover the width of the rectangular casting mold, and comprise magnetic material which is distributed so as to constitute two sub-poles, symmetrically placed along the one long-side of the respective sub-mold, for applying a magnetic field with essentially the same magnetic field direction across the entire width of the rectangular casting mold, and with an essentially symmetrical distribution in both sub-molds.

According to yet another embodiment of the invention, the brake presents magnets which are arranged at a number of levels one after the other in the casting direction. Brakes with magnets at a number of levels are particularly well suited for continuous casting in casting molds where the molten metal is discharged into the casting mold by means of a casting pipe which submerged beneath the surface of the melt, the meniscus, or so-called closed casting. Such a casting pipe is preferably arranged centrally in the casting mold or sub-mold, and has in its simplest embodiment a downwardly directed casting pipe outlet port at its bottom, which effects a primary flow in the casting direction, but the casting pipe is preferably closed at its bottom, and has a plurality of outlet ports at angles at the lower end of the casting pipe. In the case of rectangular casting molds, said side ports are arranged so as to split the melt into a plurality of primary flows which flow outwards, towards the short-sides of the casting mold. A brake according to the present embodiment usually comprises magnets at level with, or just downstreams from the casting pipe outlet ports to brake and split the incoming melt, and provide an upwardly directed secondary flow, and magnets at a second level at the meniscus to avoid a disturbed surface. For some types of casting it has proven to be advantageous to provide magnets at further levels downstreams from the casting pipe outlet ports, both in the casting mold and downstreams from the casting mold, in order to control the secondary flow, but in some cases also to secure braking of the primary flow.

The invention also relates to a device for simultaneous continuous or semi-continuous casting of two strands in parallel, comprising,

- a chill mold comprising a rectangular casting mold with an inner partition which subdivides the rectangular casting mold into two sub-molds, and support beams arranged around the rectangular casting mold, and chilling means to chill the casting mold and the support beams,
- a magnetic brake arranged to apply to melt entering into, and present in the sub-molds, a static or periodic low-frequency magnetic field. In order to generate a magnetic brake field which will act upon the strands formed in the sub-molds and melt which is present in said strands and molds with essentially the same field direction across the entire width of the rectangular casting mold, and with an essentially symmetrical distribution in both of the sub-molds, the magnetic brake is arranged in accordance with one of the above described embodiments.

Preferably a casting device according to the invention has a brake, an EMBR, which has two wide electromagnets. Said electromagnets are arranged one after the other along each of the opposing long-sides of a rectangular casting mold. Said rectangular casting mold comprises a partition which subdivides the rectangular casting mold into two sub-molds, preferably also of rectangular shape. The cores of the two electromagnets has a width such that they essentially cover the entire width of the rectangular casting mold, and a recess in the magnetic material adjacent to the partition, at that end of the core which is directed towards the casting mold. Thus, the strands which are cast in a casting device according to the invention will be subjected to a magnetic braking field which acts with an essentially symmetrical distribution over the respective of the strands, and with essentially the same field direction across the entire width of both of the strands formed in the casting device.

DESCRIPTION OF THE DRAWINGS

The invention will be explained in greater detail below, reference being made to the appended drawings, which show the use of electromagnetic brakes for castings devices for casting of two strands in parallel.

FIGS. 4*a*, 4*b* shows a casting device with an electromagnetic brake according to a preferred embodiment of the invention, while

DETAILED DESCRIPTION OF THE INVENTION

In the figures are shown a device for continuous casting of the strands of steel, so-called twin-casting. The steel is cast in a chill mold which comprises a casting mold 10 with a rectangular cross-section, subdivided into two sub-molds 11*a*, 11*b*. The casting mold is constituted by four chilled wall plates 12*a*, 12*b*, 12*c*, 12*d* and a partition 13. The partition 13 is normally displaceable sideways and subdivides the large casting mold into the two sub-molds 11*a*, 11*b*. The chill mold also comprises support beams 14*a*, 14*b* surrounding the chill. Said support beams 14*a*, 14*b* has a system of internal cavities in which a chilling agent, normally water, flows during casting, and are normally referred to as water beams. In order to brake the primary streams of hot melt which are discharged centrally into the respective sub-mold 11*a*, 11*b*, and continually formed to strands, electromagnetic brakes in different embodiments are shown in FIGS. 1*a*, 2*a*, 3*a*, 4*a*, and 5*a* arranged adjacent to the chill mold, to act over the sub-molds. Apart from braking and splitting the primary flow of hot melt, the electromagnetic brakes also give good possibilities of controlling secondary flow which arises in the non-solidified parts of the strand. It is, then, often desirable to configure the brake so as to apply a static or periodic low frequency magnetic field, a braking field, which acts with essentially the same magnetic field direction and in a symmetrical way, across a cast strand.

Figure 1A:
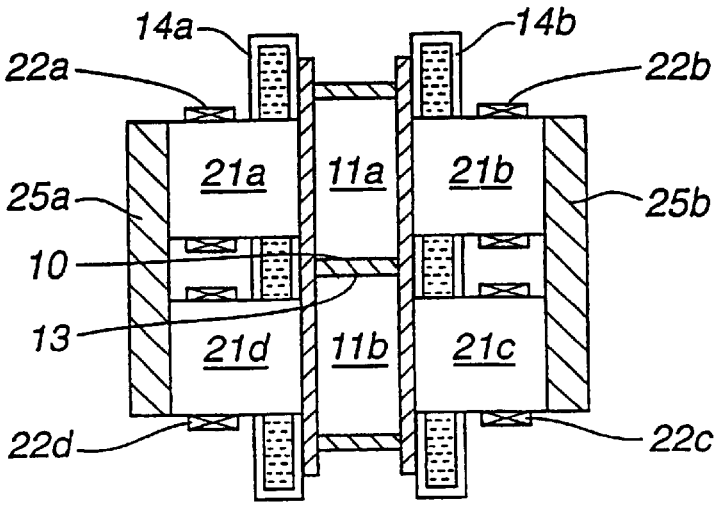
Fig. 1a (PRIOR ART)
FIGS. 1*a*, 1*b*, 2*a*, 2*b* and 3*a* and 3*b* show casting devices with electromagnetic brakes according to prior art.
Figure 1B:
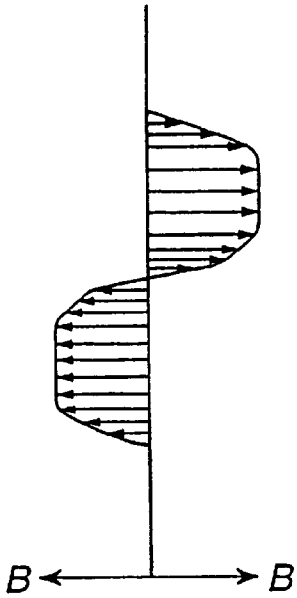
Fig. 1b (PRIOR ART)

FIG. 1*a* shows an electromagnetic brake according to the prior art which includes four magnets placed in an adjacent relationship two by two along each of the long-sides. The magnets are arranged in two pairs, each pair presenting magnets with opposite polarity arranged opposite to each other adjacent to the long-side of the rectangular casting mold 10 to apply a magnetic field over the chill mold. A magnet has a straight iron core 21*a*, 21*b*, 21*c*, 21*d* and a coil 22*a*, 22*b*, 22*c*, 22*d* arranged around the core 21*a*, 21*b*, 21*c*, 21*d*. The magnets are interconnected to a closed magnetic circuit by means of a magnetic feed-back device 25*a*, 25*b*, shown in FIG. 1*a* as a magnetic yoke arranged on the back side. With this brake, a magnetic field B with a distribution according to FIG. 1*b* will act across the melt in the strand. The magnetic field changes direction between the magnet pairs, and each of the magnet pairs has a maximum of opposing magnetic field direction. A magnetic field with this field distribution gives, in many cases, a symmetric field in each sub-mold 11*a*, 11*b*, but for brakes with cores 21*a*, 21*b*, 21*c*, 21*d* having the width of the same magnitude as the width of the sub-mold, there is a risk of the appearance of magnetic leak flows across the partition. Such leak flows may have undesired effects on the flow of the melt, and thus the quality of cast steel. As a result hereof, it is desired to have the same magnetic field direction in both of the sub-molds 11*a*, 11*b*, and thus the desired field shape is not achieved by means of this type of magnetic brake. A braking field with this configuration of the magnetic field strength may also be obtained by means of an angled iron core, which has a central portion surrounded by the coil, arranged essentially parallel to the long-side of the casting mold, and interconnected at both ends with an angled portion which at its free end is directed inwards towards the casting mold.

Figure 2A:
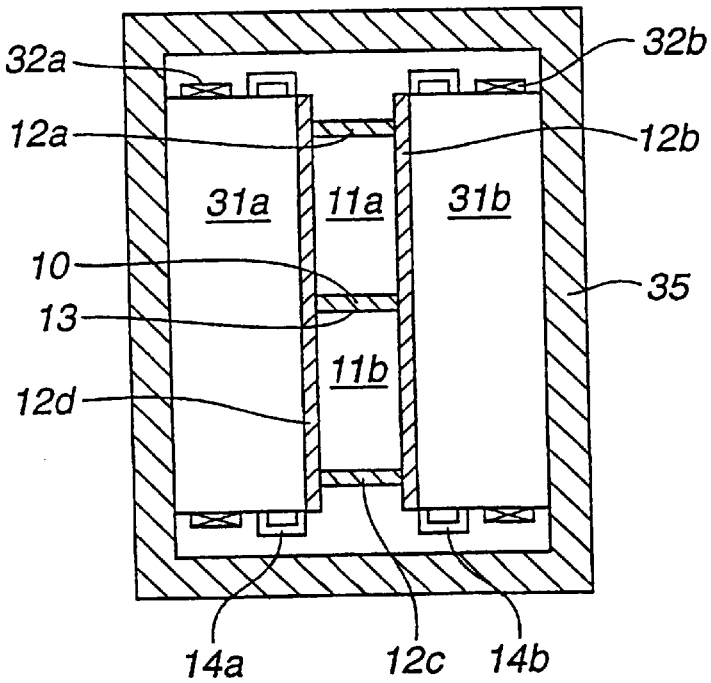
Fig. 2a (PRIOR ART)
Figure 2B:
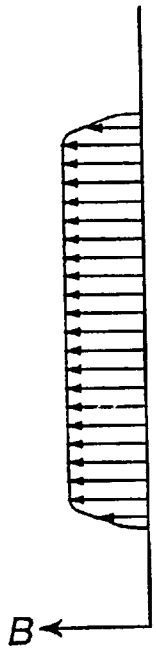
Fig. 2b (PRIOR ART)

In FIG. 2*a* there is a shown another magnetic brake according to prior art which has two magnets arranged along both of the long-sides of the rectangular casting mold 10, and an iron core 31*a*, 31*b* which is substantially wider that the casting mold 10, so that a magnetic field may be applied without any substantial decrease in the magnetic field strength inside the casting mold 10. This configuration, however, requires a lot of space, and may therefore only in special cases be installed in a device for continuous casting. The brake shown in FIG. 2*a* will apply a magnetic field B with a magnetic field direction and a field distribution according to FIG. 2*b* to act across two strands being formed in the sub-molds 11*a*, 11*b*.

Figure 3A:
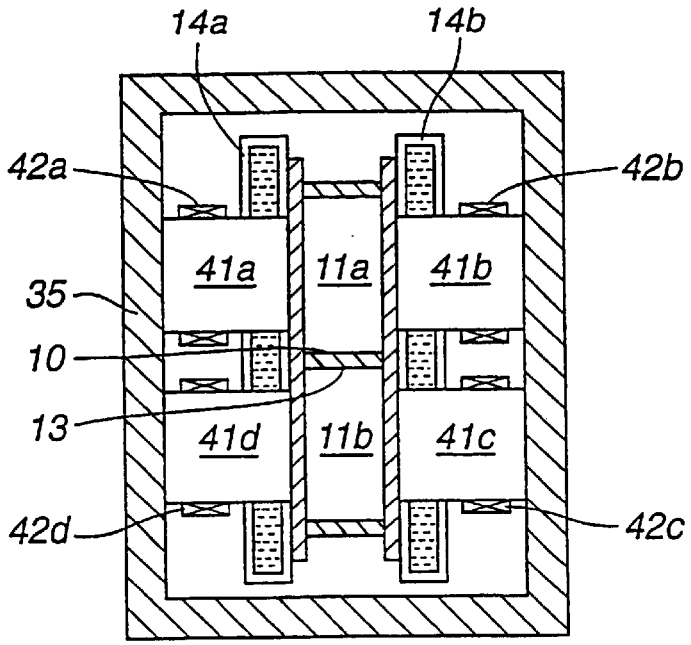
Fig. 3a (PRIOR ART)
Figure 3B:
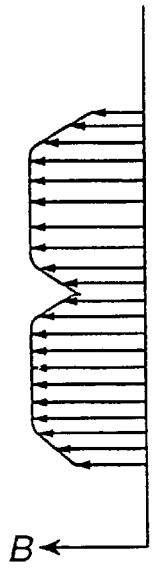
Fig. 3b (PRIOR ART)

By adding to the electromagnetic brake in FIG. 1*a* magnetic feed-back means 35 surrounding the magnets, formed of cores 41*a*, 41*b*, 41*c* and 41*d* and coils 42*a*, 42*b*, 42*c* and 42*d*, and the chill mold, as shown in FIG. 3*a*, the polarity may be changed so that the brake will apply a field B which acts with the same magnetic field direction in the both sub-molds 11*a*, 11*b*, see FIG. 3*b*. The magnetic field is symmetrical for casting where the partition 13 is placed symmetrically in relation to the magnet pairs, which normally means that it is placed at the center of the longsides 12*a*, 12*b* of the casting mold. It is often desired to cast strands with different widths in the two sub-molds 11*a*, 11*b*, whereupon the partition 13 is displaced sideways. In order to provide for the displacement of the magnets in the sideways direction, it is required that large openings have been made in the water beams 14*a*, 14*b*. It is thus only possible to use a brake according to FIG. 3*a* in some cases where it is possible to meet the above requirements concerning the dimensions of the strand, or the space available for sideways displacement of the magnets. Further, motors or other devices requiring a lot of space, are required for this sideways displacement.

Figure 4A:
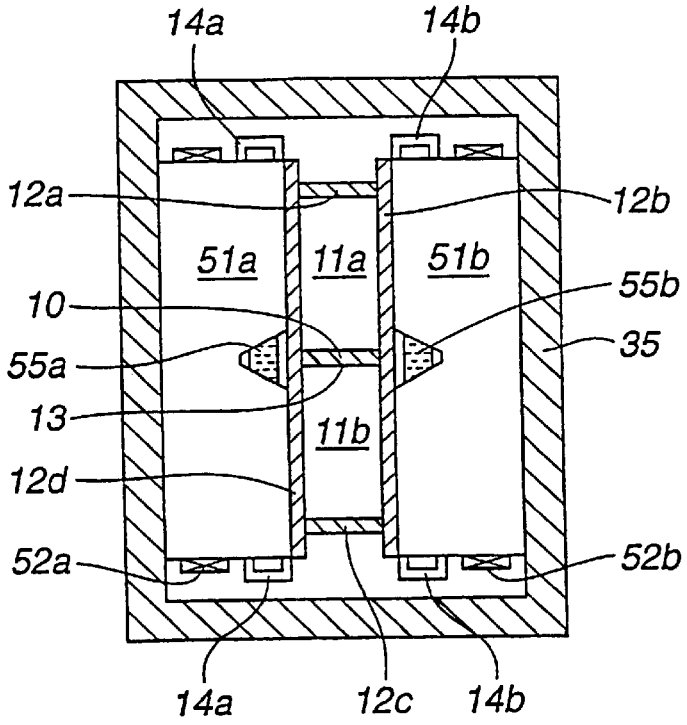
Figure 4B:
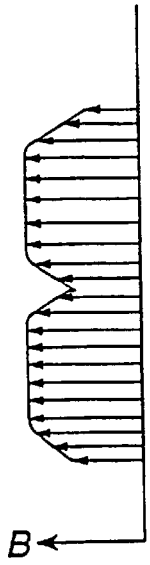
Figure 5A:
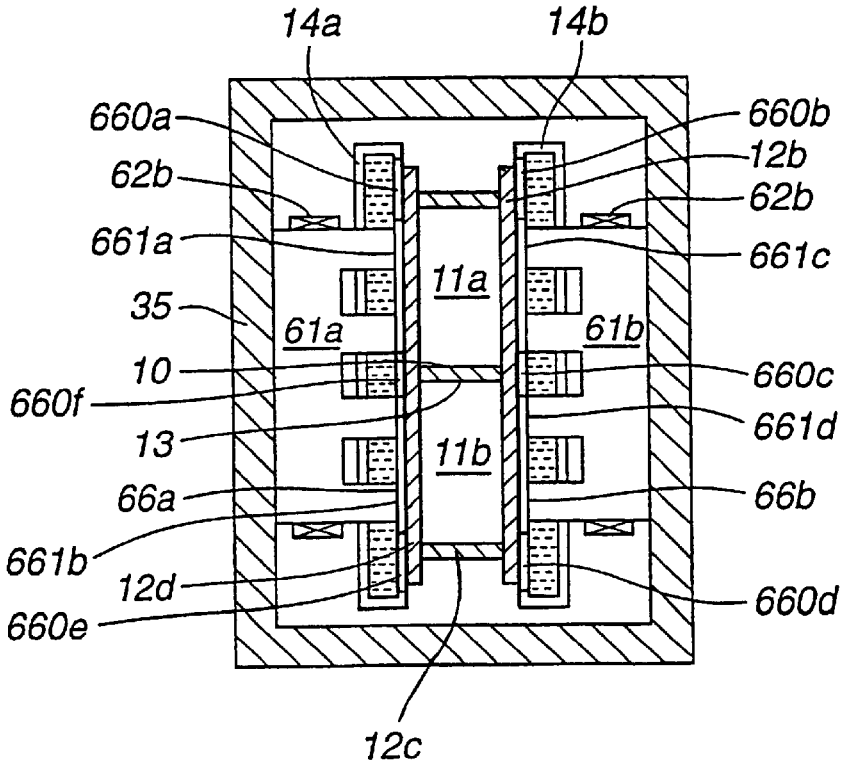
FIGS. 5*a*, 5*b* shows a casting device according to an alternative embodiment of the invention.
Figure 5B:
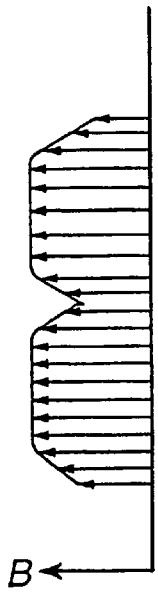

The same distribution of the magnetic field, see FIGS. 4*b* and 5*b*, is also obtained with a brake according to the embodiments of the invention which are shown in FIG. 4*a* and 5*a*, without the above mentioned limitations concerning flexibility in changing the dimensions of the strands.

The electromagnetic brake in FIG. 4*a* presents, as does the brake in FIG. 2*a*, two wide magnets, each of which has a core 51*a*, 52*b*. The magnets have different polarities, and are arranged to apply a field with the same magnetic field direction across the entire width of the rectangular casting mold, see FIG. 4*b*. The respective core 51*a*, 51*b* has, at the end which directed towards the chill mold, a recess 55*a*, 55*b*, dividing the magnet into two sub-poles. Preferably the forward end of the core has a plurality of removable sections, not shown, allowing the recess to be displaced laterally so that, for all possible adjustments mold dimensions of the sub-molds 11*a*, 11*b*, it will be located adjacent to partition 13. Thus it is possible, by means of an electromagnetic brake according to the present embodiment of the invention, to achieve an efficient braking of the incoming primary flow of hot melt, and a good control of the secondary flow in the strand for twin-casting, and to maintain this with good flexibility for all possible combinations of strand dimensions. An alternative embodiment of the invention, which is shown in FIG. 5*a*, offers the same advantages and possibilities. The brake in FIG. 5*a* has, like the one shown in FIG. 4*a*, two wide magnets including a core 61*a*, 61*b* and a coil 62*a*, 62*b*. The core is slotted at its forward end, and inserted into a corresponding cavity in the water beams 14*a*, 14*b*. In order to make the magnetic field more uniform, a pole plate 66*a*, 66*b* having magnetic material is arranged between the core and the casting mold. The pole plate includes sections of magnetic material 661*a*, 661*b*, 661*c*, 661*d*, and non-magnetic material 660*a*, 660*b*, 66*c*, 660*d*, 660*e*, 660*f*, are at least arranged adjacent to partition 13, and when the partition 13 is displaced laterally, the pole plate 66*a*, 66*b* is reconfigured so that it has a non-magnetic section 660*a*, 660*b*, 660*c*, 660*d*, 660*e*, 660*f* adjacent to the partition 13. The magnet with the wide slotted core shown in FIG. 5*a* may of course be substituted by a plurality of magnets with narrower cores of the same polarity. As is the case with the brakes in FIGS. 2*a*, 3*a*, and 4*a*, magnetic feed-back means 35 are arranged to surround the magnets and chill mold. The feed-back means 35 is in magnetic contact with the cores 61*a*, 61*b* and close the magnetic circuits.

What is claimed is:

1. A magnetic brake, arranged for use for casting of two strands in parallel in a chill mold, which has a rectangular casting mold with an inner partition subdividing the rectangular casting mold into two sub-molds, said brake having a first magnet arranged at a first long-side of the rectangular casting mold, and a second magnet of opposite polarity arranged at the opposite second long-side of the rectangular casting mold, wherein magnetic material of each of said first and second magnets is distributed into two magnetic sub-poles of the same polarity arranged adjacent to each other along each of the first and second opposing long-sides of the rectangular casting mold and both sub-poles are symmetrically arranged along the long-side of a respective sub-mold to generate and apply at least one static or periodic low frequency magnetic field with essentially the same magnetic field direction across the entire width of the rectangular casting mold, and with an essentially symmetrical distribution in both the sub-molds.

2. Magnetic brake according to claim 1, wherein said first and second magnets are permanent magnets with a width which essentially cover the entire width of the rectangular casting mold.

3. Magnetic brake according to claim 1, wherein said first and second magnets are electromagnets having cores which essentially cover the entire width of the rectangular casting mold.

4. Magnetic brake according to claim 3, wherein the cores comprised in said first and second magnets have recesses in the magnetic material adjacent to the partition at an end of the cores which is directed towards the casting mold.

5. Magnetic brake according to claim 3, wherein the cores comprised in said first and second magnets have inserts of a non-magnetic material adjacent to the partition at that end of the cores which is directed towards the casting mold.

6. Magnetic brake according to claim 1, wherein said first and second magnets have a plurality of sub-magnets arranged adjacent to each other along each of the long-sides and a pole plate which comprises magnetic material arranged between the magnets and the casting mold, wherein said pole plates essentially cover the entire width of the rectangular casting mold and comprise sections of magnetic material, wherein each pole plate defines two magnetic sub-poles of the same polarity arranged adjacent to each other along the long-side of the rectangular mold, and wherein the sub-poles are placed symmetrically along the long-side of the respective sub-mold.

7. Magnetic brake according to claim 1, wherein the brake comprises magnets arranged at a plurality of levels one after the other in the casting direction.

8. Magnetic brake according to claim 7, wherein the brake has magnets arranged at one or more levels downstreams of the casting mold.

9. A device for simultaneous continuous or semi-continuous casting of two strands in parallel, comprising, a chill mold comprising a rectangular casting mold with an inner partition subdividing the rectangular casting mold into two sub-molds and supports beams arranged circumferentially around the rectangular casting mold, and chilling means for chilling the casting mold and support beams, a magnetic brake which is arranged to apply to melt which is entering into, or present in the sub-molds, a static or periodic low frequency magnetic field, wherein a magnetic field with essentially the same magnetic field direction across the entire width of the rectangular casting mold, and which field in both of the sub-molds is essentially symmetrically distributed, is applied by a magnetic brake having first a magnet arranged at a first long-side of the rectangular casting mold, and a second magnet of opposite polarity arranged at the opposite second long-side of the rectangular casting mold, wherein magnetic material of each of said first and second magnets is distributed into two magnetic sub-poles of the same polarity arranged adjacent to each other along each of the first and second opposing long-sides of the rectangular casting mold and both sub-poles are symmetrically arranged along the long-side of a respective sub-mold to generate and apply at least one static or periodic low frequency magnetic field with essentially the same magnetic field direction across the entire width of the rectangular casting mold, and with an essentially symmetrical distribution in both the sub-molds.

* * * * *